US006833819B2

(12) United States Patent
Lynch

(10) Patent No.: US 6,833,819 B2
(45) Date of Patent: Dec. 21, 2004

(54) BEAM STEERING APPARATUS FOR A TRAVELING WAVE ANTENNA AND ASSOCIATED METHOD

(75) Inventor: Jonathan J. Lynch, Oxnard, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 10/367,613

(22) Filed: Feb. 13, 2003

(65) Prior Publication Data

US 2003/0234747 A1 Dec. 25, 2003

Related U.S. Application Data

(60) Provisional application No. 60/357,314, filed on Feb. 14, 2002.

(51) Int. Cl.[7] ..... H01Q 13/00
(52) U.S. Cl. ..... 343/781 CA; 343/781 P
(58) Field of Search ..... 315/781 CA, 781 P, 315/781 R, 780, 753, 909

(56) References Cited

U.S. PATENT DOCUMENTS

| | | | | |
|---|---|---|---|---|
| 3,255,456 A | * | 6/1966 | Lerner | 343/780 |
| 4,345,257 A | * | 8/1982 | Brunner | 343/780 |
| 4,516,130 A | | 5/1985 | Dragone | 343/781 P |
| 5,266,961 A | | 11/1993 | Milroy | 343/772 |
| 5,349,363 A | | 9/1994 | Milroy | 343/772 |
| 5,579,021 A | * | 11/1996 | Lee | 343/781 P |
| 5,627,553 A | * | 5/1997 | Poulton | 343/754 |
| 5,844,527 A | | 12/1998 | Takashima et al. | 343/781 P |
| 5,995,055 A | | 11/1999 | Milroy | 343/772 |
| 6,014,108 A | | 1/2000 | Lynch et al. | 343/753 |
| 6,101,705 A | | 8/2000 | Wolfson et al. | 29/600 |
| 2003/0038753 A1 | * | 2/2003 | Mahon | 343/781 CA |

FOREIGN PATENT DOCUMENTS

| | | |
|---|---|---|
| EP | 0 732 766 A1 | 9/1996 |
| WO | 91/17586 | 11/1991 |

* cited by examiner

*Primary Examiner*—Don Wong
*Assistant Examiner*—Ephrem Alemu
(74) *Attorney, Agent, or Firm*—Ladas & Parry

(57) ABSTRACT

Steering of an electromagnetic beam of energy in the upper plate of a plate waveguide of a traveling wave antenna concurrently with the formation of a flat phase front and collimation of the electromagnetic beam is achieved by providing a second waveguide beneath the lower plate of the first waveguide and providing a 180% bend parabolic main reflector to reflect the energy beam to the upper plate of the upper waveguide. A feed horn is located in the lower waveguide and illuminates a pivotal subreflector which reflects the energy to the parabolic main reflector. By rotating the subreflector about its pivot point, the beam which is radiated to the upper waveguide is angularly shifted or steered.

26 Claims, 3 Drawing Sheets

BEAM STEERING APPARATUS FOR A TRAVELING WAVE ANTENNA AND ASSOCIATED METHOD

This application claims the priority of U.S. Provisional Patent Application Ser. No. 60/357,314 filed Feb. 14, 2002, the disclosure of which is hereby incorporated herein by reference.

FIELD OF THE INVENTION

The present invention relates to a method and apparatus for effecting beam steering in a traveling wave antenna having low overall profile height or thickness.

BACKGROUND AND PRIOR ART

Traveling wave antennas are well known and are suited to consumer applications where overall thickness must be kept to an absolute minimum. For example, for automotive applications, it is desirable to install the antenna within a vehicle's roof region. However, the antenna preferably should not be visible, for aesthetic reasons, and this places a rigid constraint on the overall height of the antenna to about one inch for practicable vehicular applications.

Parallel plate waveguide constructions are disclosed in U.S. Pat. Nos. 5,349,363 and 5,266,961. A scanning antenna suitable for automotive use is disclosed in U.S. Pat. No. 6,014,108.

The waveguides in these patents lack the ability to achieve beam steering in a simple manner. In the known antennas, elevation beam steering is usually effected by rotating the upper plate of the waveguide which contains the radiating apertures. Such antennas are often very large and involve complex mechanical constructions to rotate the plate. Furthermore, they are relatively costly and add significantly to the overall antenna height.

SUMMARY OF THE INVENTION

An object of the present invention is to provide apparatus by which beam steering can be achieved in a traveling wave antenna while maintaining a very low overall antenna height.

A further object of the invention is to provide such apparatus in which the wave traveling in the antenna has a planar phase front across the width of the antenna.

A further object of the invention is to provide such apparatus which is simple in construction and can be adapted to a conventional waveguide of a traveling wave antenna.

The wave or beam in the waveguide travels between upper and lower plates and in accordance with the invention, steering of the beam or wave is achieved by providing a second plate guide beneath the lower plate and disposing the feed source in the second plate guide and coupling the energy between the two plate guides through a 180° bend main parabolic reflector while simultaneously collimating the phase front by said parabolic reflector. A rotatable subreflector is disposed in the second plate guide and achieves beam steering by changing the angle of incidence of the beam reflected from the subreflector to the parabolic main reflector. The change in angle is effected by pivotally supporting the subreflector and utilizing an actuator to pivot the subreflector about its pivot point. The resulting angular shifting or steering the beam is one dimensional and the steering occurs predominantly in the elevation plane. Azimuth steering is effected by rotating the entire antenna assembly.

A further object of the invention is to provide a method for steering the beam in the waveguide of the antenna, and according to the method, a beam of electromagnetic energy is directed onto the subreflector which reflects the beam to the main reflector which, in turn, reflects the beam to the waveguide of the antenna. The main reflector collimates the beam and provides the linear phase front of the beam in the waveguide. The subreflector is movable to steer the angle of the beam produced by the main reflector.

BRIEF DESCRIPTION OF THE FIGURES OF THE DRAWING

FIG. 3 is a section view, taken along line 3—3 shown in FIG. 1 while

DETAILED DESCRIPTION OF A PREFERRED EMBODIMENT

Figure 1:
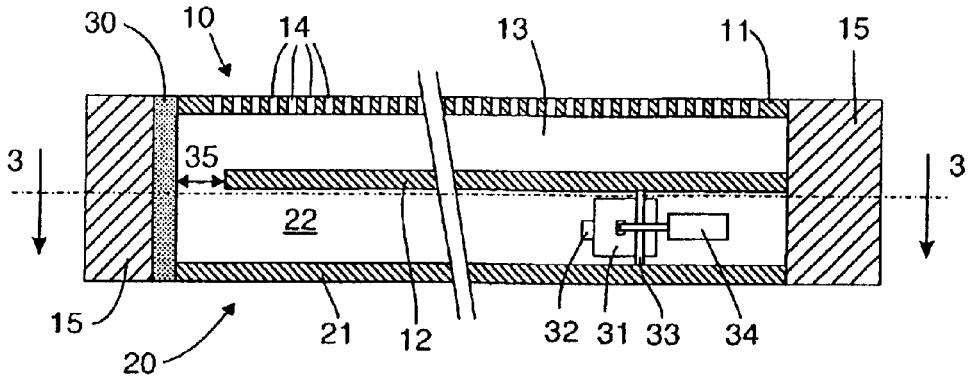
FIG. 1 is an elevational view, taken along section line 1—1 shown in FIG. 2, showing the construction of an embodiment of a waveguide having beam steering apparatus according to the present invention.
Figure 2:
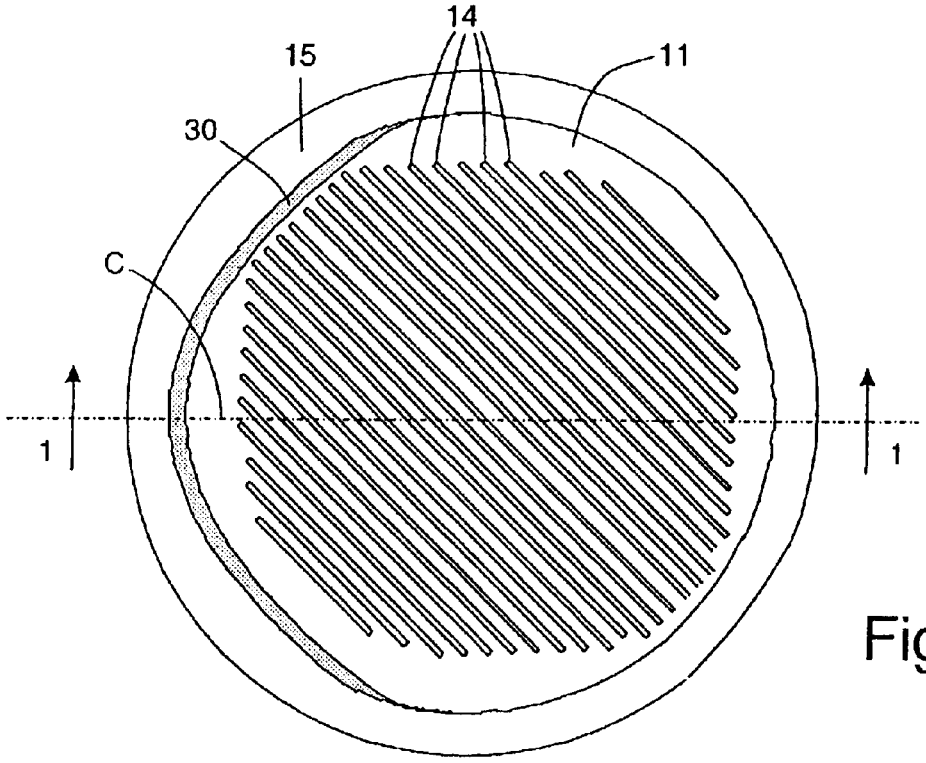
FIG. 2 is a top plan view of a portion of the upper plate of the waveguide in FIG. 1.

Referring to FIG. 1 of the drawing, therein can be seen a portion of an embodiment of a waveguide 10 for a traveling wave antenna. The waveguide 10 comprises an upper conductive plate 11 and a parallel lower conductive plate 12, separated by a dielectric medium 13. Plates 11 and 12 are preferably attached to a conductive outer wall 15. The upper plate 11 is provided with radiating apertures 14 dimensioned to provide the proper amplitude and phase distribution of the radiated energy along the length of the waveguide 10 of the antenna to its outlet end. The apertures 14 generally extend substantially across the entire width of the upper plate 11 as shown in FIG. 2. The apertures 14 are shown as rectangular slots, although other shapes are well known to those skilled in the art. The dielectric medium 13 is preferably a foam material.

Up to this point in this description, the waveguide 10 is substantially conventional and normally an energy source produces the beam or wave which travels in the waveguide with a flat phase front in order for the beam to be well collimated.

In accordance with the invention, steering of the beam is provided for the waveguide 10 by the apparatus generally denoted by numeral 20. The apparatus 20 is placed beneath the waveguide 10 in this embodiment as a second waveguide which preferably has a relatively small height in order to preserve the overall low profile of the waveguide antenna.

Figure 3:
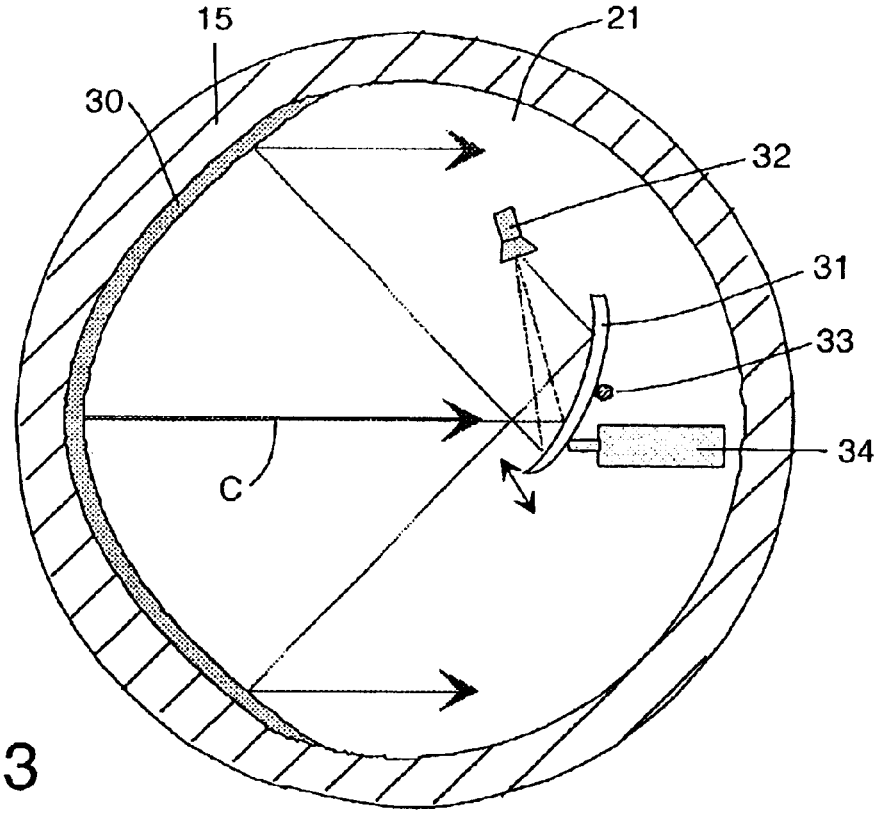
Figure 3A:
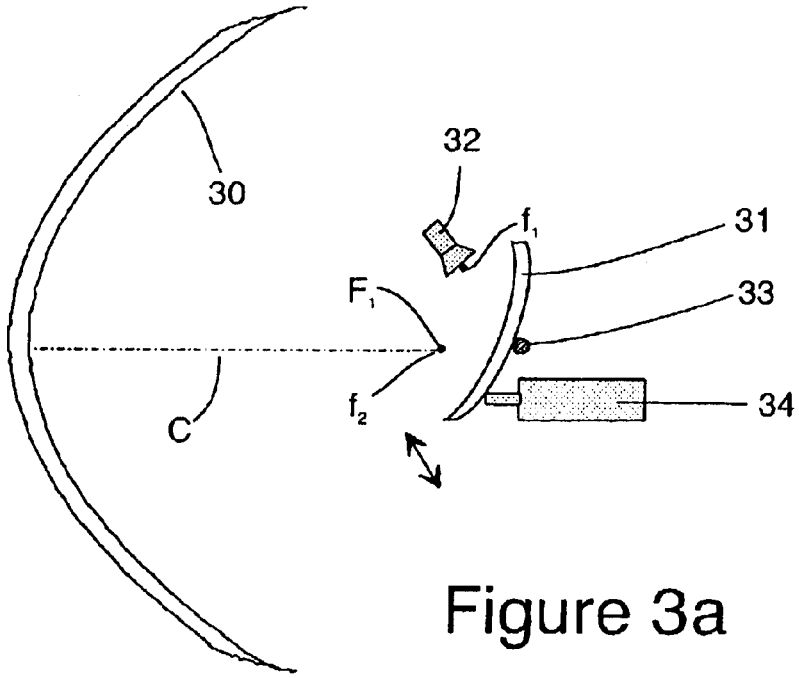
FIG. 3*a* is a diagrammatic plan view of one embodiment and FIG. 3*b* is a diagrammatic view of another embodiment, both views showing the details of the beam steering apparatus in FIG. 1.

The apparatus 20 comprises a second or lower waveguide which preferably includes a parallel lower plate 21 which is secured to the outer wall 15 of the first or upper waveguide 10. A clearance space 22 is formed between the lower plate 12 of the upper waveguide 10 and the lower plate 21 of the lower waveguide 20. A fixed main reflector 30 is positioned at an end of the antenna and spans across waveguides 10 and 20. As shown in FIGS. 3 and 3*a*, the main reflector 30 is preferably constructed as a parabolic reflector which has a focus $F_1$ (see particularly FIG. 3*a*). Positioned in clearance space 22 is a pivotal subreflector 31 facing the main reflector 30. The pivotal subreflector 31 is arranged to pivot on a pivot 33 so that the subreflector can assume many possible positions relative to the main reflector 30. The subreflector 31 preferably has an elliptical shape with foci $f_1$ and $f_2$. The subreflector 31 could also be hyperbolic in shape or even flat (see the embodiment of FIG. 3*b* discussed below). Focus $f_2$ of the ellitptical subreflector 31 is preferably coincident with focus $F_1$ of the main reflector 30 in at least one of the many possible positions of the subreflector 31.

A feed horn 32 is supported in space 22 for producing a beam of electromagnetic energy which is directed onto the subreflector 31 which, in turn, reflects the beam to the main reflector 30. The feed horn 32 is preferably at focus $f_1$ of subreflector 31 when the subreflector 31 is in a position such that the focus $f_2$ of the subreflector 31 is coincident with focus $F_1$ of the main reflector 30. The path of the beam of electromagnetic energy is schematically illustrated in FIG. 3. The main reflector 30 reflects the beam of electromagnetic energy from the subreflector 31 in a direction generally along the centerline C of the main reflector 30 upwards, in this embodiment, through an angle of 180° and into upper waveguide 10, which beam then emerges from upper plate 11. The apertures 14 in the upper plate 14 are preferably set at an angle to the centerline C of the main reflector 30. That angle may be, for example, 38°, but other angles should prove suitable since changing that angle causes the beam emitted by the upper waveguide 10 to steer.

In order to produce the planar phase front across the width of the antenna, the main reflector 30 is preferably formed as a parabolic reflector, as previously mentioned. As a result, the energy from the feed horn 32 is collimated by the parabolic reflector 30 to produce the planar phase front in the waveguide 10. In order to steer the beam of electromagnetic energy, which is reflected from the main reflector 30 and into waveguide 10, the subreflector 31, supported by pivot 33, is rotated about the pivot 33 to steer the beam of electromagnetic energy delivered to the main reflector 30 and thereby to steer the beam of electromagnetic energy in waveguide 10. Only a small amount of movement is needed to effect steering of the emitted beam and thus the foci $F_1$ and $f_2$ only need be displaced from each other slightly in response to movement of reflector 31. This discussion assumes that the foci $F_1$ and $f_2$ are coincident initially, but it is not necessary that they be coincident at any tine, recognizing that some steerage of the emitted beam will occur whenever they are not coincident.

The pivot 33 is located at an intermediate point along the length of the subreflector 31 and an actuator 34, also supported in space 22, is connected to the subreflector 31 at a location offset from pivot 33 to enable adjustable pivotal movement of the subreflector 31 about pivot 33 as shown by the arrows in FIG. 3. The rotatable subreflector 31 achieves beam steering by changing the angle of incidence of the feed energy with respect to the parabolic main reflector 30. The change of angle of the beam of electromagnetic energy in the feed beam impinging main reflector 30 produces a change of angle in the waveguide 10 which results in a shift of phase of the energy with respect to the apertures 14 thereby producing steering of the main beam. The resulting beam steering is basically one dimensional and occurs predominantly in the elevation plane. Azimuth steering can be achieved by rotating the entire assembly of the upper and lower waveguides 10 and 20 in a horizontal plane.

Figure 3B:
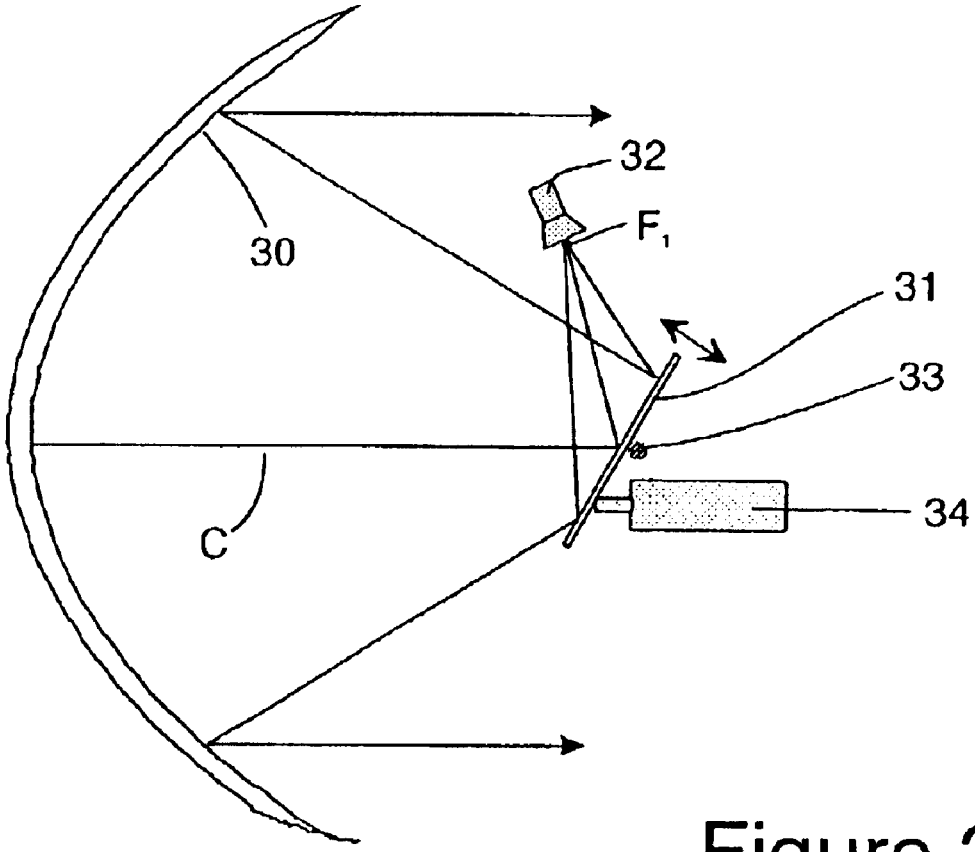

If the subreflector 31 is flat, as shown in FIG. 3*b*, then the focus $F_1$ of the main reflector 30 is preferably disposed at the feed horn 32. Moving subreflector 31 by actuator 34 will producing steering of the main beam. As in the case of the previously discussed embodiments, the resulting beam steering occurs predominantly in the elevation plane.

Subreflector 31 is preferably made of a plastic material coated with an electromagnetic beam reflective coating, such as a metallic coating, so that the subreflector 31 has a low mass (making it more responsive to movement in response to actuation of the actuator).

A gap 35 is provided at the inlet end of the lower plate 12 spacing it from the parabolic reflector 30. The energy from the feed horn 34 is coupled from the lower waveguide 20 to the upper waveguide 10 via the parabolic reflector 30, which is preferably designed to give minimal reflection back into waveguide 20 by suitable adjustment of the size of the gap 35. The leading edge of plate 12 is preferably uniformly spaced from the parabolic reflector 30 by gap 35. The cylindrical phase front from the feed horn 32 is collimated by the parabolic shape of the main reflector 30. Thus, the wave front emerging in the upper parallel plate 11 of the upper wave guide 10 has a planar phase front.

As seen from the above description in conjunction with the figures, a construction and associated method have been provided by which steering of the beam in the waveguide 10 of the antenna can be achieved by a simple construction with minimal increase in the profile height of the antenna.

Although the invention is disclosed with reference to particular embodiments thereof, it will become apparent to those skilled in the art that numerous modifications and variations can be made which will fall within the scope and spirit of the invention as defined by the attached claims.

What is claimed is:

1. A beam steering apparatus for steering a beam of electromagnetic energy in a first antenna waveguide having upper and lower conductive plates, said beam steering apparatus comprising:

a second waveguide disposed adjacent said first antenna waveguide, an energy source for producing an electromagnetic energy beam, and a beam steering assembly supported by said second waveguide to transmit said electromagnetic energy beam to the first waveguide as a collimated beam and with an adjustable angle to steer said collimated beam in said first waveguide, said beam steering assembly comprising a pivotal subreflector facing said energy source to reflect said electromagnetic energy beam and a main reflector for reflecting said electromagnetic energy beam from the subreflector to said first waveguide.

2. The beam steering apparatus as claimed in claim 1, wherein said main reflector comprises a 180° parabolic reflector.

3. The beam steering apparatus as claimed in claim 1, wherein a gap is provided between said first and second waveguides for communicating said electromagnetic energy beam from the main reflector to said first waveguide.

4. The beam steering apparatus as claimed in claim 1, further comprising a pivot supporting said subreflector and an actuator for pivoting the subreflector around said pivot to produce the steering of said beam.

5. The beam steering apparatus as claimed in claim 1, wherein said main reflector is parabolic, said subreflector being elliptical and having a focus which is coincident with a focus of said parabolic main reflector in at least one possible location of the subreflector.

6. The beam steering apparatus as claimed in claim 5, wherein the energy source is disposed at a second focus of said elliptical subreflector in said at least one possible location of the subreflector.

7. The beam steering apparatus as claimed in claim 1, wherein said main reflector is parabolic, said subreflector being flat.

8. The beam steering apparatus as claimed in claim 7, wherein the energy source is disposed at a focus of said main reflector.

9. A beam steering apparatus for a waveguide of a traveling wave antenna having upper and lower conductive plates and a source of input electromagnetic energy for producing a traveling wave in said waveguide, said apparatus comprising:

a plate guide located beneath the lower plate of the waveguide, said source of input electromagnetic energy being arranged at said plate guide, and an assembly for steering the energy from said source to said waveguide, said assembly comprising:

a pivotal subreflector facing said energy source to reflect the energy therefrom, and a main reflector facing said subreflector to reflect the energy received from the subreflector to said waveguide as a collimated energy beam with a planar wavefront, said pivotal subreflector being rotatable to steer the energy delivered to the waveguide.

10. The beam steering apparatus as claimed in claim 9, wherein said subreflector has an electromagnetic beam reflecting surface.

11. The beam steering apparatus as claimed in claim 10, wherein said main reflector has an electromagnetic beam reflecting surface.

12. The beam steering apparatus as claimed in claim 11, wherein the electromagnetic beam reflecting surface of said main reflector has a parabolic shape.

13. The beam steering apparatus as claimed in claim 12, wherein the parabolic main reflector has a 180° bend angle.

14. The beam steering apparatus as claimed in claim 12, wherein said subreflector is supported at a pivot located at an intermediate position along its length, and an actuator is provided to rotate the subreflector at said pivot.

15. The beam steering apparatus as claimed in claim 12, wherein the electromagnetic beam reflecting surface of the subreflector has an elliptical or flat shape.

16. The beam steering apparatus as claimed in claim 15, wherein said electromagnetic beam reflecting surface of said subreflector is flat and wherein said source of electromagnetic energy is located at a focus of said parabolic main reflector.

17. The beam steering apparatus as claimed in claim 15, wherein said electromagnetic beam reflecting surface of said subreflector is elliptical having a focus which is coincident with a focus of the parabolic main reflector in at least one possible location of the subreflector.

18. The beam steering apparatus as claimed in claim 17, wherein said source of electromagnetic energy is located at a second focus of said elliptical surface of said subreflector in said at least one possible location of the subreflector.

19. A method of steering a beam of electromagnetic energy in a waveguide of an antenna, said method comprising:

directing a beam of electromagnetic energy onto a subreflector, reflecting said beam from said subreflector to a main reflector which, in turn, reflects said beam to the waveguide of the antenna, forming said main reflector to collimate said beam and provide a planar phase front of the electromagnetic energy beam in the waveguide, and moving said subreflector to steer the angle of the collimated beam produced by the main reflector in the waveguide.

20. The method as claimed in claim 19, wherein said beam of electromagnetic energy is reversed in direction by 180° by said main reflector.

21. The method as claimed in claim 19, comprising forming said main reflector as a 180° bend parabolic reflector.

22. The method as claimed in claim 21, comprising forming the subreflector with an elliptical surface having one focus coincident with a focus of the parabolic reflector and producing said beam of electromagnetic energy at a second focus of said elliptical surface.

23. The method as claimed in claim 21, comprising forming the subreflector with a planar surface and producing said beam of electromagnetic energy at the focus of said parabolic reflector as reflected by the planar surface of the subreflector.

24. The method as claimed in claim 21, wherein said subreflector is moved by pivoting the subreflector about a pivot.

25. The method as claimed in claim 24, comprising positioning the main reflector adjacent to and facing said waveguide.

26. The method as claimed in claim 25, wherein the waveguide has upper and lower plates, the subreflector being supported in a space between the lower plate of the first said waveguide and a second waveguide positioned below said lower plate.

* * * * *